United States Patent [19]

Christian et al.

[11] Patent Number: 4,813,221

[45] Date of Patent: Mar. 21, 1989

[54] FLEXIBLE TENSION MEMBERS

[75] Inventors: Philip Christian, Norton; John M. Walton, Sprotbrough, both of England

[73] Assignee: Bridin plc., Doncaster, England

[21] Appl. No.: 131,257

[22] Filed: Dec. 7, 1987

Related U.S. Application Data

[63] Continuation of Ser. No. 8,052, Jan. 15, 1987, abandoned, which is a continuation of Ser. No. 683,698, Dec. 19, 1984, abandoned.

[30] Foreign Application Priority Data

Dec. 20, 1983 [GB] United Kingdom ..... 8333845

[51] Int. Cl.[4] ..... D07B 1/16

[52] U.S. Cl. ..... 57/217; 57/232

[58] Field of Search ..... 57/200, 210, 212, 217, 57/229, 232, 7, 9, 311

[56] References Cited

U.S. PATENT DOCUMENTS

| | | | |
|---|---|---|---|
| 1,537,698 | 5/1925 | Robinson . | |
| 2,106,060 | 1/1938 | Ostrander | 57/210 X |
| 2,293,918 | 8/1942 | Planiol | 174/131 |
| 2,385,241 | 9/1945 | White | 57/217 X |
| 3,188,791 | 6/1965 | Grimes et al. | 57/217 X |
| 3,457,717 | 7/1969 | Durkee et al. | 57/210 X |
| 3,717,987 | 2/1973 | Gilmore et al. | 57/9 |
| 3,800,522 | 4/1974 | Hughes et al. | 57/217 X |
| 3,840,426 | 10/1974 | Flautt et al. | 57/229 X |
| 3,848,406 | 11/1974 | Tabei et al. | 57/229 |
| 3,911,785 | 10/1975 | Hood | 87/1 |
| 4,197,695 | 4/1980 | Hughes et al. | 57/217 X |
| 4,345,112 | 8/1982 | Sugata et al. | 57/212 X |

FOREIGN PATENT DOCUMENTS

| | | | |
|---|---|---|---|
| 40877 | 12/1981 | European Pat. Off. | 57/212 |
| 0071292 | 2/1983 | European Pat. Off. . | |
| 483351 | 10/1929 | Fed. Rep. of Germany . | |
| 866018 | 2/1953 | Fed. Rep. of Germany . | |
| 2261291 | 6/1974 | Fed. Rep. of Germany . | |
| 402357 | 10/1965 | Switzerland . | |
| 891741 | 3/1962 | United Kingdom . | |
| 1193354 | 5/1970 | United Kingdom . | |
| 1481704 | 8/1977 | United Kingdom . | |
| 2036825 | 7/1980 | United Kingdom . | |
| 1589044 | 5/1981 | United Kingdom . | |

OTHER PUBLICATIONS

European Patent Application 82200892.6 published Feb. 9, 1986, Publication No. 0 071 292, Hauzenberger et al.

*Primary Examiner*—Joseph J. Hail, III

*Attorney, Agent, or Firm*—Trexler, Bushnell, Giangiorgi & Blackstone, Ltd.

[57] ABSTRACT

A flexible tension member for structural applications comprises twenty or more high strength rods (R) bundled helically with a lay length 20 to 150 times overall diameter, the rod (R) upon introduction being substantially free from curvature resulting in slackness in the bundle and introduced without flexural stresses significantly exceeding the yield point of the rod structure. The invention may utilize rods of solid circular or non-circular cross-section, or tubular and formed of metal, e.g., steel, and/or non-metallic material, more particularly fibre reinforced plastics, and results in a smooth uniform appearance, with good integrity and no signs of slackness despite the unusually long lay length employed.

12 Claims, 1 Drawing Sheet

FLEXIBLE TENSION MEMBERS

Figure 1:
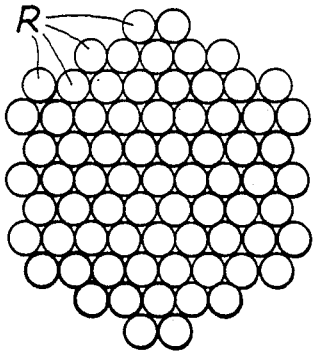

This application is a continuation of application Ser. No. 008,052, filed Jan. 15, 1987, which is a continuation of application Ser. No. 683,698, filed Dec. 19, 1984 both of which are now abandoned.

This invention relates to flexible tension members primarily for use in structural applications and comprising a bundle of high strength rods arranged helically about a common axis or central core.

The central core may consist of a rod, a strand of basic type, a tube or an electrical cable. By "rods" are meant elongate members of solid circular or non-circular cross-section or tubular and formed of metal and/or non-metallic material.

The rods may be stranded together in either a single operation so that all helices are of the same hand or in multiple operations to form concentric layers, which may have opposite hand to achieve a high degree of torsional balance.

Each rod may have a fibrous structure in which the fibres are substantially aligned with the longitudinal axis of the rod, to maximise axial strength, which orientation may be achieved, for example, by drawing the rod in its solid state through a die, extrusion or pultrusion. Alternatively, each rod may itself comprise a bundle of high strength filaments, (e.g. of steel or glass or carbon or other non-metallic materials, such as aromatic polyamide fibres) substantially aligned with the longitudinal axis of the rod—but possibly twisted together— the filaments preferably being bonded together in a cohesive matrix, e.g., of elastomeric, thermoplastic or thermosetting materials, to provide an integral structure with a measure of flexural stiffness.

Hitherto flexible tension members of the type described have generally been produced using steel wires with helical lay (or pitch) length of between 6 and 12 times the diameter of the circle circumscribing the total cross-section. This limitation has been imposed by the traditional manufacturing process and the difficulty of handling (e.g., coiling) such members if much longer lays were to be adopted—with the exception of relatively stiff constructions where the number of wires does not exceed say twenty, e.g. nineteen wire strands.

The object of the invention is to overcome the aforementioned limitation.

According to the present invention, a method of forming a flexible tension member primarily for use in structural applications comprises bundling twenty or more high strength rods helically about a common axis (or central core) with a lay length of between twenty and one hundred and fifty times the diameter of the circle circumscribing the total cross-section of the bundle, the rods immediately before introduction into the bundle being substantially free from any curvature that will result in residual slackness in the bundle and being introduced without flexural stresses significantly exceeding the yield point of the rod structure.

For best overall characteristics, the lay length is preferably between fifty and one hundred times the diameter of the circumscribing circle.

The flexural stresses induced into the rods during bundling are primarily controlled by the manufacturing method and design of the bundle. The governing factor is the curvature of te rod during and after formation into the member, which can be readily calculated for any given set of design parameters. Any curvature of the rods immediately before introduction into the bundle must be less than that imposed by the helical formation. This condition will obviously be satisfied if the rods are completely straight immediately prior to bundling, but for practical purposes some tolerance on the amount of initial curvature (or residual curvature of "straightened" rod from a coil) may be necessary and may be perfectly acceptable.

Experimental work has been carried out to demonstrate the practicality and technical advantages of the method using (5 mm) rods of both steel and composite fiber reinforced plastic (FRP) construction. The rods were substantially straight prior to forming the bundle, the actual curvature being indicated practically by a deviation from linearity not exceeding 6 mm over a 1 m span (representing a curvature value of 0.05 $m^{-1}$ or radius of curvature equal to 20 m). In each case a bundle of 73 rods brought together at a helical pitch of 3.7 m gave an overall diameter of 49 mm. The resulting curvature of the rods in the helical flexible tension member was calculated to be about 16 m, which is comfortably less than the pre-existing curvature. The resulting product exhibited a smooth and uniform appearance, with good integrity and no signs of slackness despite the unusually long lay length employed.

Tests on samples of these flexible tension members have shown a very high tensile efficiency in terms of both ultimate strength and elongation characteristics. In each case the actual breaking strength was substantially the same as the aggregate strength of the constituent rods, and the modulus of elasticity was indistinguishable from that of the individual rods. These results are significantly better than would be expected from conventional lay strand, the strength and modulus being enhanced by about 10%. Furthermore handling trials on the flexible tension members showed that they could be coiled down to a barrel diameter of 1.5 m, which is considered very satisfactory for this size and type of member.

It is apparent from the practical results described that it is possible by the methods described to manufacture a flexible tension member which has the desirable mechanical properties of a parallel wire strand, without the disadvantages of the latter.

In the above example referred to, a lay length equivalent to about 75 times the bundle diameter was applied. However, if the same levels of curvature were applied to a smaller member (using fewer rods of the same rod size) then an even larger lay ratio would apply, and vice versa. The relationship between helical pitch or lay length and the other parameters can best be illustrated in non-dimensional terms, by introducing $^{D}/d$ as the ratio of pitch circle diameter to rod diameter, $^{L}/D$ as the ratio of lay length to pitch circle diameter (see FIG. 1) and expressing the rod curvature in terms of the maximum bending strain. The following tabulation can then be derived:

| Max. | D/d | | |
|---|---|---|---|
| Strain | 5 | 10 | 20 |
| 0.01% | L/D = 140.5 | L/D = 99.3 | L/D = 70.2 |
| 0.02% | L/D = 99.3 | L/D = 70.2 | L/D = 44.6 |
| 0.05% | L/D = 62.8 | L/D = 44.3 | L/D = 31.3 |
| 0.1% | L/D = 44.3 | L/D = 31.3 | L/D = 22.0 |

The method described is particularly relevant to the use of high strength fibre reinforced plastics rods. Hitherto it has been impossible to spin such materials into a helical strand formation because of the high bending strains incurred and the deleterious effect of radial stresses at crossover points. These effects are known to cause severe loss in mechanical performance because of the inability of most composites to yield locally, and their relative weakness in the transverse direction, which in the ultimate may lead to delamination of the fibres. A means of overcoming all these problems is afforded by the method proposed. In particular the helical pitch may be selected to reflect the sensitivity of the rod material to bending strain. Furthermore, a post-forming heat treatment may be beneficially applied to the finished member to relieve the residual stresses.

The foregoing methods are equally applicable to rods of non-circular cross-section, e.g. locked coil shapes. In such cases it may be preferable to pretwist the rods to suit the helical lay of the flexible tension member so as to lessen the residual torsional stresses in the rods and ensure that the finished member is torque-free in the no-load condition.

At the longer lays referred to above it may be desirable to apply tape wrappings at either discrete intervals (e.g., 1 m apart) or continuously along the length of the flexible tension member to assist in the subsequent handling of the member. This measure is particularly appropriate if the member is being coiled for storage and transportation purposes. Alternatively, a tubular jacket of elastomeric or polymeric or otherwise flexible material may be applied to the member after forming. This wil have similar beneficial effects to the tape wrapping during handling and coiling, but will also provide additional protection to the member against abrasion and harmful environmental effects. Spaces within the member and/or tubular jacket may be filled with blocking medium, to exclude moisture and dirt.

The method of bundling rods to form flexible tension members in accordance with the invention may be advantageously carried out utilising the method and equipment described in UK application No. 8420383.

Figure 2:
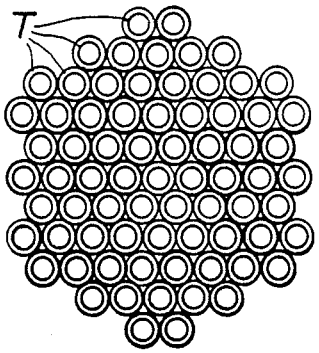
Figure 3:
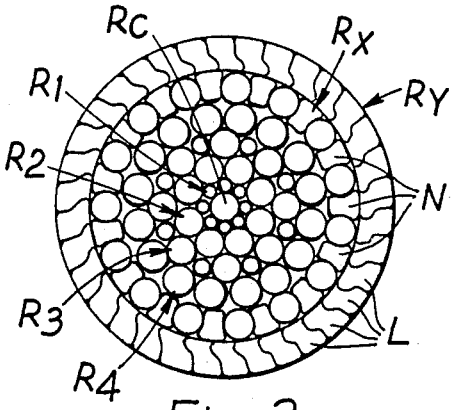
Figure 4:
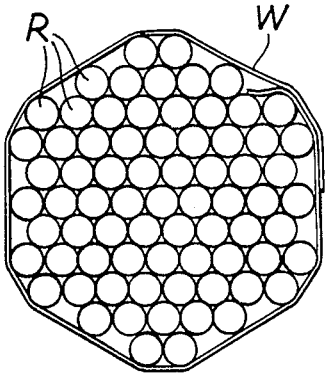
Figure 5:
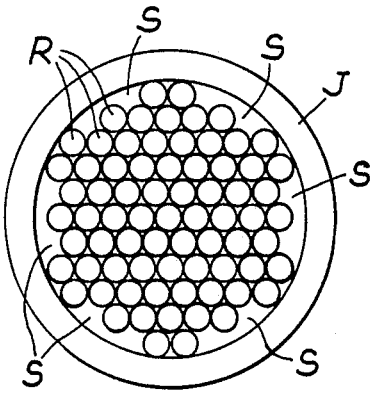
Figure 6:
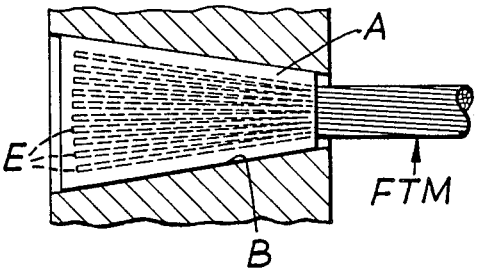

A number of embodiments of flexible tension members formed in accordance with the invention will now be described by way of example only, with reference to the accompanying diagrammatic drawings, in which:

FIG. 1 is a cross-section of the flexible tension member that was the subject of the experimental work hereinbefore described;

FIGS. 2 and 3 correspond to FIG. 1 but illustrate the use of tubular and non-circular rods respectively;

FIGS. 4 and 5 also correspond to FIG. 1 but illustrate the addition of tape wrappings and a tubular jacket respectively; and FIG. 6 is an axial section through an end fitting for anchoring a flexible tension member formed in accordance with the invention.

In the embodiment of FIG. 1 seventy-three rods R of solid circular section are shown bundled together. These rods, which can be of steel or composite (FRP) construction, have a diameter of 5 mm and when bundled together at a helical pitch of 3.7 m give an overall diameter of 49 mm for the resulting flexible tension member, which exhibits a smooth and uniform appearance, with good integrity and no sign of slackness despite the unusually long lay length employed (in this case, seventy-five times the overall diameter of the flexible tension member).

In the embodiment of FIG. 2 seventy-three rods T of tubular form are shown bundled together similarly to the solid rods R in FIG. 1. Again, the tubular rods T can be of steel or composite construction, and with the outside diameter at 5 mm and the same helical pitch of 3.7 m also gives an overall diameter of 49 mm for the resulting flexible tension member, which has equally good characteristics to that of FIG. 1.

The embodiment of FIG. 3 has a combination of solid circular rods of various diameters and two forms of solid non-circular rods. A central solid circular rod $R_C$ and four layers of solid circular rods $R_1$ to $R_4$ respectively form a central strand formed in accordance with the invention, and two further layers $R_X$ and $R_Y$ are bundled around the strand in accordance with the invention. The layer $R_X$ consists of circular rods alternating with mating non-circular rods N, and the layer $R_Y$ consists solely of locked coil rods L, and the non-circular rods N and L are preferably twisted before introduction into the bundle to suit the helical lay of the flexible tension members.

The embodiment of FIG. 4 is basically the same as in FIG. 1, but has tape wrappings W at discrete intervals along its length or continuously along its length, while the embodiment of FIG. 5 is also basically the same as in FIG. 1 but has a tubular jacket J of flexible material (e.g., elastomeric material), and the spaces S within the tubular jacket are preferably filled with blocking medium to prevent ingress of moisture and dirt.

The flexible tension members described above may be readily terminated or anchored using conventional end fittings, for example of the type illustrated by FIG. 6 having a cone A and socket B, with the ends of the rods of the flexible tension member FTM concerned spread into a conical array embedded in the cone, which may consist of filled polyester or epoxy resin systems—although other formulation of materials for the cone may be necessary, depending on their compatability with the rod material and to achieve adequate bond strength. The reliability of the anchorage may be improved by splitting the ends E of composite rods within the length of the cone A, to provide an increased surface area for bonding purposes. In practical tests this form of anchorage has proved highly efficient, breaks produced by testing to destruction being clear of the fitting, thus demonstrating that the strength of the flexible tension member can be utilised to the full.

What we claim is:

1. A method of forming a flexible tension member for use in structural applications comprising bundling at least twenty high strength metal rods of at least 5 mm diameter helically about a common axis with a lay length of between fifty and one hundred and fifty times the diameter of the circle circumscribing the total cross-section of the bundle, the rods immediately before introduction into the bundle being in a substantially straight condition such that the curvature of the rods immediately before introduction into the bundle is less than that imposed by the subsequent helical bundling, such that the rods are free from any curvature that will result in residual slackness in the bundle and the rods being introduced into the helical bundle without flexural stresses at any time exceeding the yield point of the rod material.

2. A method as in claim 1, wherein the lay length is between fifty and one hundred times the diameter of the circumscribing circle.

3. A method as in claim 1 or claim 2, wherein the rods are completely straight immediately before introduction into the bundle.

4. A method as in claim 1 or claim 2, wherein rods of non-circular cross-section are included within the bundle and are twisted before introduction into the bundle to suit the helical lay of the flexible tension member.

5. A method as defined in claim 1, wherein the flexible tension member is provided with tape wrappings along its length.

6. A method of forming a flexible tension member for use in structural applications comprising bundling at least twenty high strength fiber reinforced plastic rods helically about a common axis with a lay length of between fifty and one hundred and fifty times the diameter of the circle circumscribing the total cross-section of the bundle, the rods immediately before introduction into the bundle being free from any curvature that will result in residual slackness in the bundle and being introduced without flexural stresses at any time exceeding the yield point of the rod material, and wherein a post-forming heat treatment is applied to the finished member.

7. A flexible tension member for use in structural applications comprising at least twenty high strength metal rods of at least 5 mm diameter bundled helically about a common axis with a lay length of between fifty and one hundred and fifty times the diameter of te circle circumscribing the total cross-section of the bundle, the rods immediately before introduction into the bundle being in a substantially straight condition such that the curvature of the rods immediately before introduction into the bundle is less than the final curvature of the rods as a result of the helical bundling, such that the rods are free from any curvature that will result in residual slackness in the bundle, and the rods being introduced into the helical bundle without flexural stresses at any time exceeding the yield point of the rod material.

8. A flexible tension member as defined in claim 7 and further including a tubular jacket of flexible material.

9. A flexible tension member as defined in claim 8, wherein any spaces are filled with a blocking medium.

10. A flexible tension member for use in structural applications comprising at least twenty high strength rods of fibre reinforced plastic bundled helically about a common axis with a lay length of between fifty and one hundred and fifty times the diameter of the circle circumscribing the total cross-section of the bundle, the rods immediately before introduction into the bundle being free from any curvature that will result in residual slackness in the bundle and being introduced without flexural stresses at any time exceeding the yield point of the rod material.

11. A flexible tension member as in claim 10, with a tubular jacket of flexible material.

12. A flexible tension member as in claim 11, wherein any spaces are filled with blocking medium.

* * * * *